United States Patent [19]

Seifert et al.

[11] 3,969,978

[45] July 20, 1976

[54] DIRECT INJECTION LIQUID PROPELLANT GUN SYSTEM

[75] Inventors: Kerry D. Seifert; Parker C. Smiley, both of Oakland, Calif.

[73] Assignee: The United States of America as represented by the Secretary of the Air Force, Washington, D.C.

[22] Filed: Dec. 20, 1974

[21] Appl. No.: 535,339

[52] U.S. Cl. ..... 89/7

[51] Int. Cl.[2] ..... F41F 1/04

[58] Field of Search ..... 89/7, 9

[56] References Cited

UNITED STATES PATENTS

| | | | |
|---|---|---|---|
| 2,965,000 | 12/1960 | Skinner | 89/7 X |
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |
| 3,313,208 | 4/1967 | Dorsey et al. | 89/7 |
| 3,800,657 | 4/1974 | Broxholm et al. | 89/7 |

*Primary Examiner*—David H. Brown

*Attorney, Agent, or Firm*—Joseph E. Rusz; Arsen Tashjian

[57] ABSTRACT

A liquid propellant gun system which operates by the direct injection of a two-component hypergolic liquid propellant, i.e., a liquid oxidizer and a liquid fuel, into the combustion chamber in the gun to the rear of the projectile to be propelled. The preferred embodiment is an adaption of the inventive gun system for use as a rapid fire, small caliber, high muzzle velocity aircraft cannon system. As the hypergolic components come into contact and burn, the projectile is propelled forwardly through and out of the gun barrel by the resultant combustion gases. Unlike the prior art, the inventive system permits a significantly higher rate of fire of projectiles, eliminates the need for an igniter, prevents misfires and detonations, materially increases the reliability of the gun and the system thereof, and greatly reduces both the weight and the volume needed to house and to use the gun and the other components of the system.

5 Claims, 1 Drawing Figure

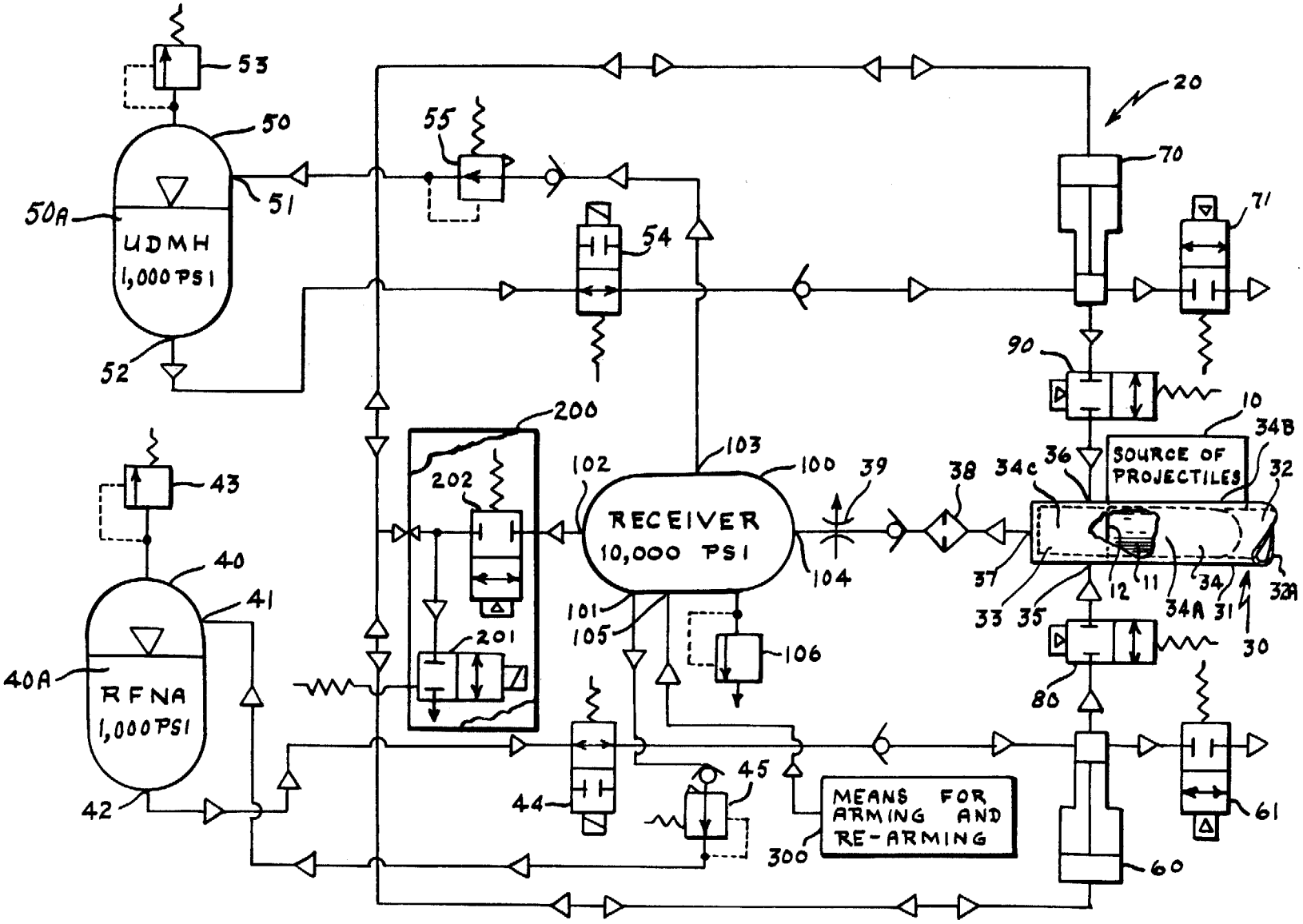
SOURCE OF PROJECTILES
RECEIVER 10,000 PSI
MEANS FOR ARMING AND RE-ARMING
UDMH 1,000 PSI
RFNA 1,000 PSI

DIRECT INJECTION LIQUID PROPELLANT GUN SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to a unique direct injection liquid propellant gun system and, more particularly, to such a system which is adapted for use as a rapid fire, small caliber, high muzzle velocity aircraft cannon system.

The advantages of a liquid propellant gun over a conventional powder gun are numerous. Immediately, a cartridge case becomes unnecessary and can be removed. This per se is an asset, for by removing the cartridge case the cost of each round is reduced; the weight of each round is reduced; the volume of each round is reduced; the necessity for a spent cartridge ejection mechanism is eliminated; and, the projectile loading and handling mechanisms can be made more rugged and also can be made to operate faster. Additionally, liquid propellants are generally more dense and more energetic than conventional powder propellants; thus, there can be a savings in the total volume of propellant required to propel a projectile. Also, with a liquid propellant, relatively low flame temperatures can be obtained without a loss in impetus. Further, for a given projectile load, there is a savings both in weight and in volume in a liquid propellant gun and in the system of which it is a part.

The relative merits of a direct injection liquid propellant gun, as compared to a bulk-loaded liquid propellant gun, are more subtle. Direct injection capability allows the use of hypergolic propellant formulation, which increases the reliability of the gun, since the need for an igniter and an ignition subsystem is eliminated. The danger of a misfire or of a hang fire is negligible, since the introduction of both reactive products guarantees ignition. A direct injection system has no cook-off problem, since the propellant vaporizes and burns as it is injected. Research into bulk-loaded guns indicates that bulk loading is apt to cause burning instabilities and possible catastrophic detonation, unless extreme care is taken in the loading method. This type of instability problem does not exist in a direct injection liquid propellant gun. Mechanically, a direct injection gun can achieve a higher rate of fire than a bulk-loaded gun, since the extra step of loading the propellant behind the projectile before ignition is removed.

It is, therefore, readily apparent that a direct injection liquid propellant gun system is very desirable and, in fact, would constitute a significant advance in the state-of-the-art.

We have invented such a direct injection liquid propellant gun system, which said system will be disclosed and taught hereinafter.

SUMMARY OF THE INVENTION

Our invention pertains to a direct injection liquid propellant gun system, wherein a two-component hypergolic liquid propellant is used, and also wherein the gun system is adapted for use as a rapid fire (e.g., 6000 rounds per minute), small caliber (e.g., 30mm), high muzzle velocity (e.g., 3500 feet per second) aircraft cannon system which is in combination (i.e., in operative connection) with a source of small caliber projectiles (i.e., rounds) suitable for use in and with said aircraft cannon system adaptation.

An object of this invention is to teach the structure of a unique liquid propellant gun system, wherein direct injection of the liquid propellant is used.

Another object of this invention is to teach the structure of a preferred embodiment of our unique propellant gun system, as said preferred embodiment is adapted for use as a rapid fire, small caliber, high muzzle velocity, aircraft cannon system, in combination with a source of small caliber projectiles.

Still another object of this invention is to teach the use of a two-component hypergolic liquid propellant in said preferred embodiment.

These objects, and other equally important and related objects, of our invention will become readily apparent after a consideration of the description of the invention, coupled with reference to the drawing.

DESCRIPTION OF THE DRAWING

The drawing is a top plan view, in simplified form, partially schematic and partially diagrammatic, of a preferred embodiment of our inventive system, and of the fluid power flow therein, as adapted for use as a rapid fire, small caliber, high muzzle velocity aircraft cannon system. The symbols shown therein are from the art-accepted "U.S.A. Standard Graphic Symbols for Fluid Power Diagrams", USAS Y32.10-1967, available from the American Society of Mechanical Engineers, United Engineering Center, 345 E. 47th St., New York, N.Y. 10017.

DESCRIPTION OF THE PREFERRED EMBODIMENT

With reference to the drawing, therein is shown a preferred embodiment 20 of our inventive gun system, as adapted for use as an aircraft cannon system which is in combination with a source 10 of suitable small caliber (e.g., 30mm) projectiles, such as representative projectile 11 having a base 12 at the rear thereof.

In overview, the preferred embodiment 20 includes in operative connection, but is not limited to: at least one aircraft cannon (i.e., gun) 30 having a combustion chamber 34C; a first reservoir 40 containing a suitable liquid oxidizer 40A of the appropriate hypergolic characteristic (i.e., one component of the two-component hypergolic liquid propellant used in the system); a second reservoir 50 containing a suitable liquid fuel 50A of the complementary hypergolic characteristic (i.e., the other component of the two-component hypergolic liquid propellant used in the system); a first pressure intensifier 60 to increase the pressure of the liquid oxidizer 40A; a second pressure intensifier 70 to increase the pressure of the liquid fuel 50A; a first injector valve 80 to inject the liquid oxidizer 40A from the intensifier 60 directly into the combustion chamber 34C of the gun 30; a second injector valve 90 to inject the liquid fuel 50A from the intensifier 70 directly into the combustion chamber 34C of the gun 30; a third reservoir 100 (hereinafter referred to as the "receiver") to store some of the gases resulting from the hypergolic combustion of the oxidizer 40A and of the fuel 50A in the combustion chamber 34C of the gun 30, and thereafter releasing or feeding the stored combustion gases back into the gun system 20; a 3-way valve 200 of the piezoelectric type to control the flow of fluids within the system 20; and, means for arming 300, totally disarming, and re-arming 300 the gun system 20.

More specifically, the representative aircraft cannon or "gun" 30 (of which, in a modification of this embodiment, there may be a plurality) has a barrel 31 of preselected finite length, with the barrel 31 having a fore end 32 with a muzzle 32A thereat and an aft end 33 with a chamber 34 therein, with the chamber 34 having a fore end portion 34A (with a closeable opening 34B therein) capable of receiving, accepting, and housing a projectile, and each projectile one at a time, such as 11, from the source of projectiles 10, and with the chamber 34 also having an aft end portion 34C located to the rear of the base 12 of the projectile 11, with this aft end portion 34C (hereinafter referred to as the "combustion chamber") of the entire chamber 34 being capable of receiving, housing, and withstanding the combustion of a suitable liquid two-component hypergolic propellant which includes the aforementioned liquid oxidizer 40A (preferably red fuming nitric acid) and the aforementioned liquid fuel 50A (preferably unsymmetrical dimethylhydrazine). Said combustion chamber 34C also has a first inlet 35, a second inlet 36, and an orifice 37.

The first reservoir 40 contains the liquid oxidizer 40A; has an inlet 41 and an outlet 42; has attached a first relief valve 43 which "cracks" at 1200 psi; and, is operatively connected from its outlet 42 to the first inlet 35 of the gun combustion chamber 34C.

The second reservoir 50 contains the liquid fuel 50A; has an inlet 51 and an outlet 52; has attached a second relief valve 53 which "cracks" at 1,200 psi; and, is operatively connected from its outlet 52 to the second inlet 36 of the gun combustion chamber 34C.

A first valve 44 (i.e., a supply shut-off valve) is interposed between, and is operatively connected to, the first reservoir 40 and the gun combustion chamber 34C to control the flow of the liquid oxidizer 40A.

A second valve 54 (i.e., another supply shut-off valve) is interposed between, and is operatively connected to, and second reservoir 50 and the gun combustion chamber 34C to control the flow of the liquid fuel 50A.

A first pressure intensifier 60 is interposed between shut-off valve 44 and gun combustion chamber 34C; and, has attached to it 60 a (first) venting valve 61.

A second pressure intensifier 70 is interposed between shut-off valve 54 and gun combustion chamber 34C; and, has attached to it 70 a (second) venting valve 71.

A first injector valve 80 is interposed between, and is operatively connected to, the first pressure intensifier 60 and the first inlet 35 of the gun combustion chamber 34C.

A second injector valve 90 is interposed between, and is operatively connected to, the second pressure intensifier 70 and the second inlet 36 of the gun combustion chamber 34C.

A third reservoir 100, the "receiver", has a first outlet 101, a second outlet 102, a third outlet 103, an orifice 104, and an inlet 105. The receiver 100 is operatively connected: at and by orifice 104 to orifice 37 of gun combustion chamber 34C; at and by first outlet 101 to inlet 41 of first reservoir 40; and, at and by third outlet 103 to inlet 51 of second reservoir 50. The receiver 100 has attached to it a (third) relief valve 106 which "cracks" at 12,000 psi.

A third valve 45 (i.e., a pressure regulator valve) is interposed between, and is operatively connected to, the receiver 100 and the first (oxidizer) reservoir 40.

A fourth valve 55 (i.e., another pressure regulator valve) is interposed between, and is operatively connected to, the receiver 100 and the second (fuel) reservoir 50.

A filter 38 is interposed between, and is operatively connected to, orifice 37 of gun combustion chamber 34C and orifice 104 of receiver 100.

A fifth valve 39 (i.e., a flow control valve) is interposed between, and is operatively connected to, the filter 38 and orifice 104 of receiver 100.

A sixth valve 200 (i.e., a piezoelectric actuated 3-way valve) is interposed between, and is operatively connected to, outlet 102 of receiver 100 and oxidizer pressure intensifier 60 and fuel pressure intensifier 70. This valve 200 comprises, in operative combination a piezoelectric actuated intensifier supply valve 201 and a piezoelectric actuated vent valve 202.

A means for arming 300 the gun system 20 comprises preferably an electronically fired gas-generating squib.

A means for disarming comprises, in preferred embodiment 20, first valve 44, second valve 54, first venting valve 61, and second venting valve 71.

The disarming is physically accomplished by closing the supply shut-off valves 44 and 55 and, thereafter, opening the venting valves 61 and 71, thereby removing all of the oxidizer and the fuel from the respective pressure intensifiers 60 and 70.

A means for re-arming, also generally designated with reference numeral 300, comprises preferably a plurality of electronically fireable gas-generating squibs.

It is here to be noted that first pressure intensifier 60, second pressure intensifier 70, first injector valve 80, second injector valve 90, and the piezoelectric actuated 3-way valve 200 are proprietary to, and obtainable from the Physics International Company, 2700 Merced St., San Leandro, Cal. 94577.

MANNER OF OPERATION OF THE PREFERRED EMBODIMENT

The effect of the structure of, and the general manner of operation of, our unique direct injection liquid propellant gun system, as adapted for use as a rapid fire, small caliber, high muzzle velocity aircraft cannon system, are very easily understandable by a person of ordinary skill in the art, from the herein contained description of the preferred embodiment 20, coupled with reference to the drawing, particularly the directional fluid flow arrows thereof.

More specifically, a description in greater detail of the manner of operation of our unique gun system 20 is as follows:

The system 20 is armed by electronically firing a gasgenerating squib of the means for arming 300. This action fills the receiver 100 with gases which are, preferably, at 10,000 psi, and also pressurizes the oxidizer reservoir or tank 40 and the fuel reservoir or tank 50, preferably, at 1,000 psi. The outflow of the hot gases that are stored in the receiver 100 is controlled by the piezoelectric 3-way valve 200. The piezoelectric actuated intensifier supply valve 202 thereof 200 opens, allowing the gases to fill the respective gas chamber of each of the two pressure intensifiers 60 and 70. The respective volume of the oxidizer 40A and of the fuel 50A in the respective intensifiers are the amounts necessary to propel the projectile 11 and to operate the system 20. Since each pressure intensifier 60 and 70 is, preferably, a piston-and-plunger hydraulic one with resultant pressure area of 5-to-1, and further since the oxidizer 40A and the fuel 50A gases which have been admitted into their respective intensifier 60 and 70 from the receiver 100 are at 10,000 psi, the respective gases in the individual intensifiers are therefore compressed or "intensified" to a pressure of 50,000 psi therein. Then, the liquified gases are introduced into their respective injector valves, i.e., the oxidizer liquid 40A to injector valve 80 and the fuel liquid 50A to injector valve 90. These injector valves 80 and 90 prevent pre-dribble of the liquid two-component hypergolic propellant, because they 80 and 90 do not open until the pressure exceeds 15,000 psi; however, once open, the injector valves 80 and 90 require only 2,000 psi to remain open. The oxidizer 40A is injected by valve 80 into the combustion chamber 34C of the gun 30; and, similarly, the fuel 50A is injected by valve 90 into the combustion chamber 34C of the gun 30. When these two components 40A and 50A of the hypergolic liquid propellant come into contact in the combustion chamber 34C, they burn and from resultant combustion gases, some of which act on the base 12 of projectile 11, thereby propelling it forwardly and out of the gun barrel 31, and some of which said resultant combustion gases pass from the combustion chamber 34C to the receiver 100 through filter 38 and through flow control valve 39, which said valve limits the volume of this gas that is flowing to the receiver 100.

The next projectile from the source 10, and each projectile subsequent thereto, is "fired" (i.e., propelled forwardly and out of gun barrel 31 of gun 30) separately and in sequence, without the need to again arm the system. The firing of projectiles continues until the system is disarmed, as explained hereinbefore. Then to "restart" the firing the means for re-arming is used.

CONCLUSION

It is readily apparent from all of the foregoing, and from the drawing, that the started and desired objects of our invention have been attained. In addition, related desirable objects have been achieved, such as for example: (1) the attainment of a higher rate of fire of projectiles; (2) the elimination of the need for an igniter; (3) the prevention of misfires, hand fires, and detonation; (4) the increased reliability of the gun 30 and of the gun system 20 as a whole; and (5) the great reduction in weight and volume needed to house and use the gun 30 and the other components of the system 20.

It is to be noted that, although there have been described the fundamental and unique features of our inventive gun system as adapted for and applied to a particular preferred embodiment 20, various other embodiments, substitutions, additions, omissions, adaptations, and like will occur to and can be made by, those of ordinary skill in the art, without departing from the spirit of the invention. For example, preferred embodiment 20 can be adapted to include a plurality of gun barrels, such as 31, rather than only one gun barrel 31, as shown in the drawing.

What is claimed is:

1. A direct injection liquid hypergolic bipropellant gun system, adapted for use as a rapid fire, small caliber, high muzzle velocity aircraft cannon system which is in combination with a source of small caliber projectiles suitable for use in the aircraft cannon system, wherein each of the said projectiles has a base at the rear thereof comprising:

a. at least one aircraft cannon, having a barrel of preselected finite length, with said barrel having a fore end with a muzzle thereat and an aft end with a chamber therein, with said chamber having a fore end portion with a closeable opening capable of receiving, accepting, and housing a projectile from the source of projectiles, and with said chamber also having an aft end portion located to the rear of the base of the projectile, wherein said aft end portion of said barrel chamber is capable of receiving, housing, and withstanding the combustion of a suitable liquid hypergolic propellant which includes a liquid fuel and a liquid oxidizer, and further wherein said aft end portion of said barrel chamber has a first inlet, a second inlet, and an orifice;

b. a first reservoir containing a suitable liquid oxidizer of the hypergolic type, with said reservoir having an outlet and an inlet, with said outlet of said first reservoir connected to said first inlet of said aft end portion of said barrel chamber, and with said first reservoir having attached thereto a first relief valve;

c. a second reservoir containing a suitable liquid fuel of the hypergolic type, with said reservoir having an outlet and an inlet, with said outlet connected to said second inlet of said aft end portion of said barrel chamber, and with said second reservoir having attached thereto a second relief valve;

d. a first valve interposed between, and connected to, said first reserovir and said aft end portion of said barrel chamber, with said first valve being of the shut-off type to control the flow of said liquid oxidizer;

e. a second valve interposed between, and connected to, said second reservoir and said aft end portion of said barrel chamber, with said second valve being of the shut-off type to control the flow of said liquid fuel.

f. a first pressure intensifier interposed between said first valve and said aft end portion of said barrel chamber, with said first pressure intensifier having attached thereto a first venting valve;

g. a second pressure intensifier interposed between said second valve and said aft end portion of said barrel chamber, with said second pressure intensifier having attached thereto a second venting valve;

h. a first injector valve interposed between, and connected to, said first pressure intensifier and said first inlet of said aft end portion of said barrel chamber;

i. a second injector valve interposed between, and connected to, said second pressure intensifier and said second inlet of said aft end portion of said barrel chamber;

j. a third reservoir having a first outlet, a second outlet, a third outlet, an orifice, and an inlet, with said third reservoir connected at said orifice to the said orifice at the said aft end portion of said barrel chamber to permit the inflow, the storage, and the outflow of said resultant combustion gases which flow out of said orifice at said aft end portion of said barrel chamber, and with said third reservoir connected at said first outlet to said inlet of said first reservoir containing said liquid oxidizer of the hyperbolic type, and with said third reservoir connected at said third outlet to said inlet of said second reservoir containing said liquid fuel of the hyperbolic type, and with said third reservoir having attached thereto a third relief valve;

k. a third valve interposed between, and connected to, said third reservoir and said first reservoir, with said third valve being of the pressure regulator type;

l. a fourth valve interposed between, and connected to, said third reservoir and said second reservoir, with said fourth valve being of the pressure regulator type;

m. a filter interposed between, and connected to, said orifice of said aft end portion of said barrel chamber and said third reservoir;

n. a fifth valve interposed between, and connected to, said filter and said orifice of said third reservoir, with said fifth valve being of the flow control type;

o. a sixth valve interposed between, and connected to, said second outlet of said third reservoir, and said first and said second pressure intensifiers, with said sixth valve being of the piezoelectric three-way type;

p. means for arming said liquid bipropellant gun system;

q. and, means for rearming said liquid bipropellant gun system.

2. A direct injection liquid hypergolic propellant gun system, as set forth in claim 1, wherein said suitable liquid oxidizer of the hypergolic type if red fuming nitric acid.

3. A direct injection liquid hypergolic propellant gun system, as set forth in claim 1, wherein said suitable liquid fuel of the hypergolic type is unsymmetrical dimethylhydrazine.

4. A direct injection liquid hypergolic propellant gun system, as set forth in claim 1, wherein said first and said second pressure intensifiers each is a piston-and-plunger hydraulic intensifier with a resultant area ratio of five-to-one.

5. A direct injection liquid hypergolic propellant gun system, as set forth in claim 1, wherein said sixth valve of the piezoelectric three-way type includes a piezoelectrically actuated intensifier supply valve in operative connection with a piezoelectrically actuated vent valve.

* * * * *